US011369220B2

(12) United States Patent
Volle et al.

(10) Patent No.: US 11,369,220 B2
(45) Date of Patent: Jun. 28, 2022

(54) VARIABLE CONTOUR PILLOW AND METHOD OF MAKING THE SAME

(71) Applicant: SIRIUS SLEEPER, LLC, Clackamas, OR (US)

(72) Inventors: M. Catherine Volle, Aloha, OR (US); Justin Clausse, Happy Valley, OR (US)

(73) Assignee: Sirius Sleeper, LLC, Happy Valley, OR (US)

( * ) Notice: Subject to any disclaimer, the term of this patent is extended or adjusted under 35 U.S.C. 154(b) by 238 days.

(21) Appl. No.: 16/546,273

(22) Filed: Aug. 20, 2019

(65) Prior Publication Data

US 2020/0361762 A1 Nov. 19, 2020

Related U.S. Application Data

(63) Continuation-in-part of application No. 29/691,376, filed on May 15, 2019, now Pat. No. Des. 898,440.
(Continued)

(51) Int. Cl.
*A47G 9/10* (2006.01)
*B68G 7/12* (2006.01)
(Continued)

(52) U.S. Cl.
CPC ..... *A47G 9/109* (2013.01); *A47C 20/02* (2013.01); *A47G 9/10* (2013.01); *B68G 7/12* (2013.01);
(Continued)

(58) Field of Classification Search
CPC ... B68G 7/12; B68G 7/06; B68G 1/00; B68G 2001/005; A47C 20/02; A47G 9/10;
(Continued)

(56) References Cited

U.S. PATENT DOCUMENTS 3,266,065 A * 8/1966 Bereday ..... A47C 31/026 5/408
4,173,048 A * 11/1979 Varaney ..... A47C 20/021 5/498

(Continued)

OTHER PUBLICATIONS

Jennifer Musolf, Clone Pillow: A revolutionary body pillow for restful sleep, posted at kcikstarter.com, Kickstarter, PBC © 2019, [online], [site visited Aug. 8, 2019], 13 pages, available from Internet, <URL: https://www.kickstarter.com/projects/clonepillow/clone-pillow-a-revolutionary-body-pillow-for-restf>.

*Primary Examiner* — Peter M. Cuomo
*Assistant Examiner* — Rahib T Zaman
(74) *Attorney, Agent, or Firm* — Howard Russell

(57) ABSTRACT

Variable contour pillow and method of making the same, comprising: a pillow cover preferably with internal seams, a plurality of internal interconnecting members that define the thickness and/or taper of the pillow in desired locations along the length and/or width of the pillow, the method comprising steps of attaching the interconnecting members during the process of filling the pillow, alternately preferably hand filling behind an interconnecting member, interconnecting the interconnecting member, filling in front of the first interconnecting member and a next interconnecting member, interconnecting the next interconnecting member, and so on, until the pillow is completely filled and desired multiple levels of fill and/or surface tapers are achieved, with specific application to construction of a form-fitting body pillow with variable shape and thickness of fill material.

7 Claims, 10 Drawing Sheets

Related U.S. Application Data

(60) Provisional application No. 62/884,655, filed on Aug. 8, 2019.

(51) Int. Cl.
*A47C 20/02* (2006.01)
*B68G 7/06* (2006.01)
*B68G 1/00* (2006.01)

(52) U.S. Cl.
CPC ..... *A47G 9/1081* (2013.01); *B68G 1/00* (2013.01); *B68G 7/06* (2013.01); *B68G 2001/005* (2013.01)

(58) Field of Classification Search
CPC .. A47G 9/1081; A47G 9/1054; A47G 9/1072; A47G 9/109
See application file for complete search history.

(56) References Cited

U.S. PATENT DOCUMENTS 6,131,219 A * 10/2000 Roberts ..... A47G 9/1027 5/636
6,751,817 B1 * 6/2004 Leach ..... A47C 20/021 5/630
6,874,183 B1 * 4/2005 Taylor ..... A47C 20/021 5/630
7,080,421 B1 * 7/2006 Delfs ..... A47G 9/0207 5/502
7,461,424 B2 * 12/2008 Lindell ..... A47G 9/10 428/304.4
7,467,432 B2 * 12/2008 Brogan ..... A47G 9/10 5/636
9,021,635 B1 * 5/2015 Leach ..... A47C 20/02 5/632
10,736,444 B1 * 8/2020 Leach ..... A61G 13/1225
10,806,278 B1 * 10/2020 Leach ..... A47G 9/1072
10,898,007 B1 * 1/2021 Rozon ..... A47G 9/10
2004/0068795 A1 * 4/2004 Hollander ..... A47G 9/10 5/502
2005/0257320 A1 * 11/2005 Mollett ..... A47G 9/10 5/636
2007/0067914 A1 * 3/2007 Littlehorn ..... A47C 20/025 5/632
2009/0025147 A1 * 1/2009 Palmer ..... A47C 27/002 5/644
2010/0175194 A1 * 7/2010 Mastrosimone-Gese ..... A47D 13/083 5/639
2011/0179576 A1 * 7/2011 Regan ..... A47G 9/10 5/645
2013/0263377 A1 * 10/2013 Wootten, Jr. ..... A47C 27/15 5/640
2014/0215719 A1 * 8/2014 Gibbons ..... A47C 20/021 5/632
2016/0270566 A1 * 9/2016 Soreano ..... A47C 27/124
2017/0099967 A1 * 4/2017 Holbrook ..... A47G 9/10
2020/0154912 A1 * 5/2020 Del Balso ..... A47G 9/1027

* cited by examiner

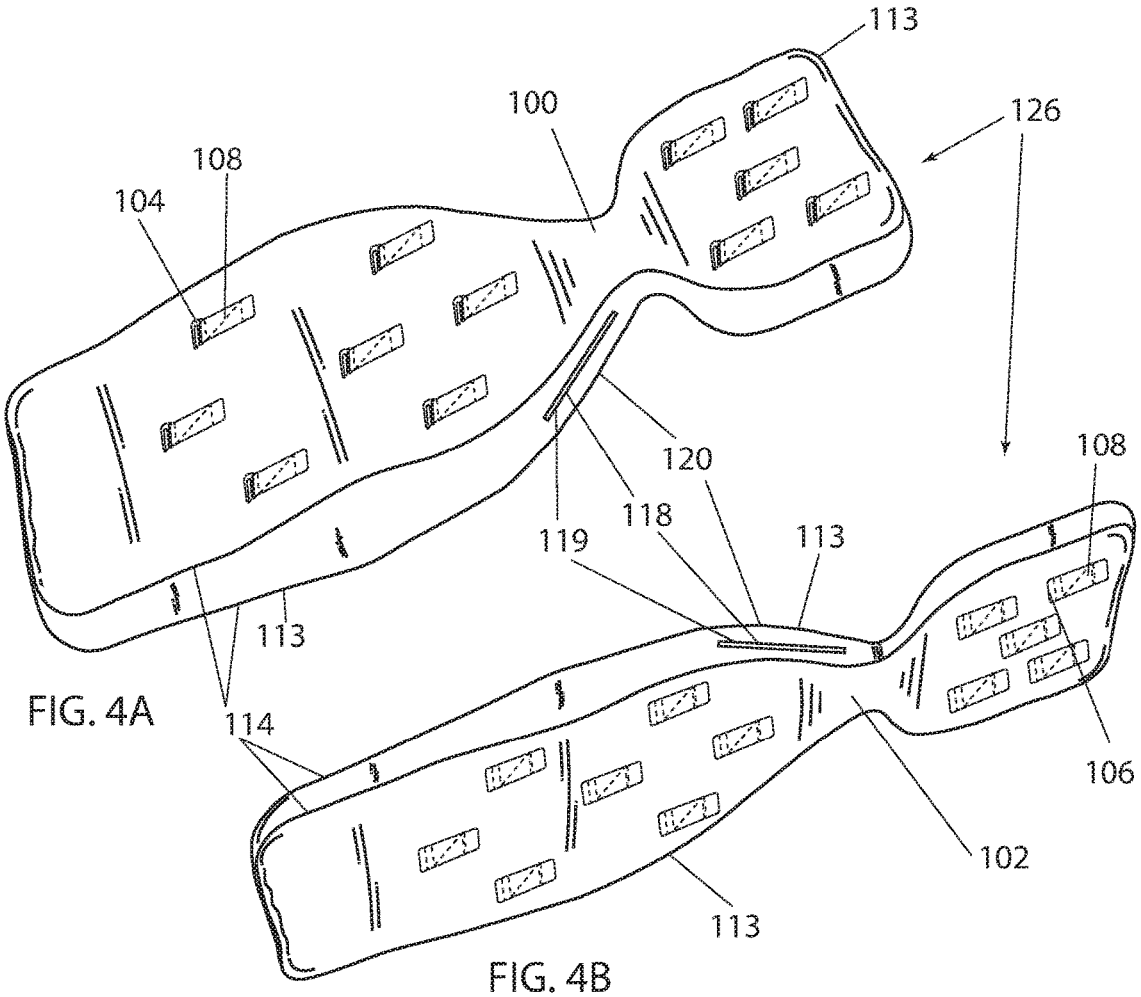
FIG. 4A
FIG. 4B
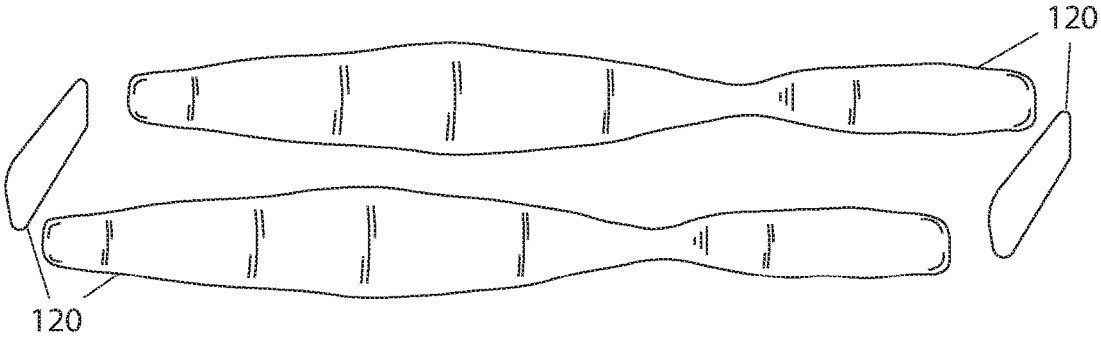
FIG. 4C

VARIABLE CONTOUR PILLOW AND METHOD OF MAKING THE SAME

REFERENCE TO RELATED APPLICATIONS

The present Patent Applications is a Continuation-in-Part of and claims the priority and benefit of U.S. Design patent application Ser. No. 29/691,376 to Justin Clausse (Inventor and Applicant), for BODY PILLOW, filed 15 May 2019, and claims the benefit of U.S. Provisional Patent Application Ser. No. 62/884,655 to Justin Clausse et al. (Inventor) with Sirius Sleeper, LLC as Applicant, for VARIABLE CONTOUR PILLOW AND METHOD OF MAKING THE SAME, filed 8 Aug. 2019.

FIELD

The present disclosure relates to a pillow, and a method for making the same, having an arbitrary shape and at least one of varying thickness and density along one or more dimensions thereof, and more particularly to such a pillow having an arbitrary shape and varying thicknesses, and a method for making the same, that tends to consistently maintain its originally manufactured shape, preventing undue bunching of fill therein, while also enabling varying density fill characteristics along one or more dimensions thereof so as to be adapted for differing, but comfortable, cushioning needs.

BACKGROUND

Pillows have long been used and serve a variety of purposes, from purely decorative to orthopedic to providing comfort and support during sleep. In recent times, pillows designed for comfort have utilized one of a number of fill materials using natural or synthetic fibers, pellets, or pre-cut foam patterns.

Where softness of the pillow has been desired, along with the flexibility for a variety of fill densities at different locations in the pillow, a fiber fill has been commonly used. Fibers may move or shift within the pillow when under pressure, and fiber-filled pillows that are used for cushioning have had to include design elements to keep the fill from moving and reducing the cushioning ability.

One common technique for reducing fill movement has been to limit the size of the pillow. With a restricted volume available, the fill has nowhere else to move within the pillow, and it is thus kept in place. A larger pillow, however, may experience unwanted shifts in the fill material.

A method of construction for imparting a decorative pattern or button to an already filled pillow has been to tuft the pillow. Tufting, as with a button, creates a decorative and somewhat limited varied exterior surface thickness of the pillow and serves to assist with holding the pillow's fill within a limited area.

Tufting is accomplished by pulling strong thread through a constructed pillow in several loops and securing the ends of the thread with buttons. The process has resulted in areas of high compression within the pillow, preventing the fill material from moving. The tufting has been normally repeated in decorative patterns over the surface of pillows of larger size, but typically has also resulted in the addition of hard components on the outside of the pillow. The process has been used in both the manufacture of pillows and upholstery, but primarily only where the thickness of the finished product has been relatively uniform.

U.S. Pat. No. 3,266,065, for Tufted Upholstery Cushion, to Bereday, teaches such a cushion construction using anchoring tufting buttons, piping, ribing or welting on the back or seat cushions of upholstered furniture.

Construction of pillows, or more commonly down comforters, with internal baffles has also been known. Such baffles have completely divided bedding into discrete sections, such as with a comforter, or they may have only partially divided the pillow as shown in U.S. Pat. No. 7,467,432, to Brogan. A common characteristic of prior baffled pillows, and especially box construction type pillows, is that they have been sewn together with raw edge seams on the outside, together with a binding, or piping, to finish the outside seam. Such a binding has resulted in a more rigid and less soft area of the pillow which has been uncomfortable for a user to lay on.

Pre-cut foam has also been used in constructing soft pillows. The fill density, however, has been determined by the inherent qualities of the foam, so adjusting the fill density has required specifying a different foam. An example of a filled foam pillow is found in U.S. Pat. No. 7,461,424, to Lindell, for Method and Apparatus for a Pillow Including Foam Pieces of Various Sizes.

Further, pillows have been constructed out of larger-sized cut foam. With such pillows, the process for cutting complex shapes, involving the outside perimeter and the thickness of the foam, has been expensive to set up and to modify. An example of such a memory foam pillow is found in US Patent Publication No. 2005/0257320, to Mollett.

The most common construction of a cushioning pillow with soft edges has been where the covers of the pillow have been sewn together, then turned 'inside-out', resulting in no external seams. This process results in a pillow with tapered edges, and has been commonly referred to as a 'knife-edge pillow'. This type of pillow has provided a high degree of flexibility in the shape of the pillow, since the covers can easily be cut to arbitrary shapes. In addition, the density of the fill material has been easily adjusted by adding more or less fill material during construction, or if an opening has been preserved with a zipper closing, for example, adding or removing fill material via the opening in the pillow. Prior art pillows of this construction have not allowed for much contouring of the thickness of the pillow other than the natural tapering of the edges.

A popular article for encouraging comfortable sleep has consisted of a pillow that is long enough to provide cushioning for a user's body, not just the head and neck, and especially for those areas that may have become uncomfortable without additional cushioning. This type of pillow has been commonly referred to as a 'body pillow', and has been especially popular with those who prefer sleeping or falling asleep while on their side. In the position of a 'side-sleeper', bony areas of the body, such as elbows, knees and ankles may be in contact with one another and exert unwanted and uncomfortable pressure. The body pillow has been used to cushion these pressure areas, and it has also been promoted to ease pressure on the spine by allowing the body to align to a more natural position. An example of such a pillow may be found in U.S. Pat. No. 6,751,817, to Leach, for Countoured Body Pillow.

Despite variations in the dimensions of the human body, and the importance of individual preference in products intended for comfort, body pillow products have commonly used a tube-shaped pillow, with only some variation in length or curvature. The cushioning options in body pillows have commonly been limited to choices of fill material and density, which typically have been uniform across the length of the pillow. Users, therefore, have had to identify which combination of fill material and density is the most comfortable compromise for their sleep habits and body dimensions.

In addition to the limited choices of the overall shape of the pillow, users have had to accept products that have not been contoured to adapt to the need for differing levels of cushioning in different portions of the body. Bony areas of the body, such as knees and ankles, need more cushioning, and soft tissue areas, such as abdomen and calves, require less cushioning.

Additionally, due to movement by the user during sleep, the soft fill in the pillow has had a tendency to move away from points of pressure, reducing the ability of the pillow to cushion such bony areas, frequently to the point of disturbing sleep.

Common commercially-available products have attempted to solve the problem of soft fill redistribution by restricting tube-shaped pillows to a limited cross-section diameter. This restriction on diameter has been partially effective in restricting movement of the fill, but such a solution has not addressed the need for a wider pillow or for variability of fill thickness for different areas of the body.

Because of the loss of comfort, tufting has not been deemed appropriate for sleep or for body pillows. Piping to cover external seams also has not been desirable when used for sleep or in body pillows because of a lesser degree of comfort associated with such methods of manufacture of pillows wherein the seams have created indentations on the user's face and other areas of the body coming into contact with such.

Therefore there has been needed a process to construct a soft pillow with any of a variety of arbitrary shapes, from square, to rectangular, to round, or other arbitrary shape, and with variable thickness and cushioning ability along one or more dimensions of the pillow (lengthwise or crosswise/widthwise), without external components such as buttons, seams, or ribbing, that have compromised the cushioning function, with special application to construct a pillow of a shape to match the human body and that may enable variable fill densities to help appropriately cushion different areas of the body. Further such a pillow would retain the shape and location within the pillow of the soft fill to preserve the comfort of the user.

SUMMARY OF THE INVENTION

In accordance with an aspect of the disclosure, there is provided a method for constructing a pillow comprising: cutting material in a desired shape to produce a top pillow cover and a bottom pillow cover; implementing a first portion of an interconnecting member with a first portion of an interconnectible thickness controlling member; implementing a second portion of the interconnecting member with another portion of the interconnectible thickness controlling member, wherein a combined length of the first and second portions of the interconnectible thickness controlling member connected together is controlling of a desired thickness of the pillow at a given location on the pillow; attaching the first portion of the interconnectible thickness controlling member with the first portion of the interconnecting member to an inner surface of the top pillow cover; attaching the another portion of the interconnectible thickness controlling member with the second portion of the interconnecting member to an inner surface of the bottom pillow cover in a location adapted to be across from and corresponding with the portion of the interconnectible thickness controlling member with the first portion of the interconnecting member attached to the top pillow cover; aligning the top pillow cover and the bottom pillow cover with the outside surface of each cover facing each other so as to be adapted to enclosing of the pillow; creating a closeable opening for the pillow and associating the closeable opening with the pillow making it adapted to facilitate filling the pillow with fill through the closeable opening; interconnecting the top pillow cover and the bottom pillow cover along corresponding perimeters of the covers, preferably with an interconnecting member such as thread sewing in a hidden seam, or such as by using an elongated interconnecting member, or panel preferably using hidden seams and such as may be used for a box pillow-type construction but in a pillow of potentially arbitrary shape; turning the pillow inside out through the opening—when using this latter type of box construction, interconnecting the top pillow cover and the bottom pillow cover step preferably further comprises sewing an elongated interconnecting edge cover along the perimeter of each the top pillow cover and the bottom pillow cover, and the creating of a closeable opening for the pillow and associating the closeable opening with the pillow step comprises installing a zipper into the elongated interconnecting edge cover; adding fill material to the inside of the pillow through the closeable opening and behind the corresponding first and second portions of interconnecting members (relative to the closeable opening); interconnecting to form an interconnected combination the first interconnecting portion of the interconnecting member to the second portion of the interconnecting member at the interior of the pillow, the interconnected combination being located in front of the fill material; adding fiber fill material to the inside of the pillow through the opening and in front of the interconnected combination (relative to the closeable opening); and closing the closeable opening.

In accordance with an embodiment of this aspect of the disclosure, either or both the first portion of the interconnectible thickness controlling member and/or the second portion of the interconnectible thickness controlling member comprises a ribbon portion, such as a first ribbon portion and/or a second ribbon portion. Further, in accordance with an embodiment of this aspect of the disclosure, the first portion of the interconnecting member preferably comprises a hook, and the second portion of the interconnecting member preferably comprises a loop. Thus, in accordance with this embodiment, the implementing a first portion step comprises attaching the first ribbon portion to a hook, wherein the implementing a second portion step comprises forming a loop in the another ribbon portion. The interconnectible thickness controlling members may either be detachable after they have first been connected, or not detachable.

Further, in accordance with this embodiment, the attaching the first portion step comprises attaching the first ribbon portion with the hook to the inner surface of the top pillow cover, and the attaching the another portion step comprises attaching the another ribbon portion with the loop to the inner surface of the bottom pillow. Thus, it will be appreciated that throughout the disclosure that any portion of the disclosure that refers to interconnectible thickness control/controlling members, or an interconnected combination, this may also be appropriately referred to as ribbons, or a ribbon pair, respectively.

Preferably, in accordance with this aspect and embodiment, the implementing a first portion step, the implementing a second portion step, the attaching the first portion step, and the attaching the another portion step, are repeated such that a plurality of ribbon portions with hooks and a corresponding plurality of ribbon portions with loops, are each attached correspondingly to different locations on the inner surface of the top pillow cover and the inner surface of the bottom pillow cover, respectively. And thus, further, preferably each adding fiber fill material to the inside of the pillow step, and the interconnecting to form an interconnected combination step, are repeated as necessary to complete filling different locations of the pillow and adapted for facilitating at least one of a plurality of pillow thickness changes and a plurality of fill density changes along one or more dimensions of the pillow.

Still further, in accordance with another embodiment and aspect of the disclosure, there is provided that each implementing a second portion step further comprises forming a plurality of loops in each of the plurality of another portion/ribbon strips, such that the length of each interconnected combination may be differently adapted with differently-positioned, different-height, plurality of loops, to facilitate producing a pillow with variable thicknesses, tapers, and/or densities along the length or width of the pillow.

Preferably, each hook in accordance with one or more embodiments and aspects of the disclosure comprises a g-shaped hook, e.g., a g-hook, and each interconnecting to form an interconnected combination step comprises manually hooking such a g-hook with a loop, and each of the plurality of loops is sewn into each another ribbon to allow for differing length interconnected combinations using the same first ribbon portions with a g-hook and the same another ribbon portions with the plurality of loops, depending on which of the plurality of loops a particular g-hook is hooked into.

In this way, the maker is enabled in easily varying the length of the interconnected combination to establish varying, new, different tapers, and/or levels, of fill along a length or width dimension of the pillow as desired.

Preferably, in accordance with an embodiment of one or more aspects of the disclosure, the opening in the pillow is secured with a zipper sewn between the top pillow cover and the bottom pillow cover such that the closing the enclosure step further comprises closing the zipper.

Further, preferably, the pillow is hand-filled with fiber fill, however, it will be appreciated by those skilled in the art that the step of adding the fill material may just as well comprise pouring of sand, pellets, or other fill material, whether by hand or with a machine, for pouring filling material to the inside of the pillow, without departing from the broader aspects of the disclosure and as claimed.

The aforementioned methods aspect of the disclosure provide a variable-thickness and/or taper pillow, whether a conventional pillow, a specialty pillow, or a body pillow, that is adaptable to be filled to varying densities along the length or width of the pillow and that is adaptable to include varying levels of thickness and/or taper along the length and/or width of the pillow so as to be able to adequately cushion varying portions of a person's body, or otherwise.

Thus, further, in accordance with an aspect and a specific embodiment of the disclosure, there is provided a method for constructing a pillow of arbitrary shape and thickness, comprising the following steps:

a. Cut material for the top and bottom pillow covers in the desired shape;
b. Prepare one or more pairs of ribbons of fabric to be used as internal attachment points within the pillow:
   i. For each of half of the ribbons, attach a g-hook by looping the ribbon through the closed portion of the g-hook and sewing the end of the ribbon to the body of the ribbon;
   ii. For each of the other half of the ribbons, create a loop by folding the ribbon and sewing the end of the ribbon to the body of the ribbon, it being the case that this step may be repeated multiple times within a single ribbon in order to provide different levels of loops within which to hook an open portion of the g-hook;
   iii. For each ribbon with a hook or loop, designate a portion of the ribbon on the end opposite the g-hook or the loop as the area to be sewn to the inside of the top or bottom pillow cover, referred to as a ribbon attachment zone.
   iv. Thus, a ribbon pair, also known as an interconnected combination, will consist of one ribbon attached to a g-hook and one ribbon with at least one sewn loop. Of course, it will be appreciated that other forms of hooks and loops may be used without departing from the spirit of the invention as claimed.

Further, then, wherein a plurality of interconnected combinations, or ribbon pairs, are employed in an embodiment of pillow, at each desired location or locations on the pillow where the thickness will be controlled by the ribbon pairs, the user may sew the ribbon attachment zone of one ribbon of the ribbon pair to the top pillow cover on the side that will become the inside of the pillow and then sew the ribbon attachment zone of the other opposing, corresponding, ribbon of the ribbon pair to the corresponding location on the bottom pillow cover, on the side that will become the inside of the pillow.

In this way, after all ribbons have been attached to the top and bottom pillow covers, the user is advised to position the top and bottom pillow covers one on top of the other with what will become the outer surfaces of the pillow covers adjacent to each other, and to sew peripheral seams around the edges of the pillow covers (in the case of a knife-edge pillow design), including a section for example for a zippered opening.

Then, the maker is advised to turn the pillow right side out by utilizing the zippered opening, such that the ribbons with g-hooks and sewn loops will now be on the inside of the pillow, but not yet connected. This, in turn will allow the maker to stuff the pillow by hand with the desired fill material through the zippered opening. Accordingly, regardless of the shape of the pillow, the maker is advised to start with the portions of the pillow farthest from the opening, and as the fill material reaches the locations of the ribbons, the maker is advised to connect the g-hooks to the sewn loops, ensuring control of the thickness of the pillow at that point. The fill density is determined by the amount of filling inserted, and is controlled at the time of manufacture. In this manner, the maker continues stuffing the pillow and connecting the ribbons as the maker moves closer to the zipper opening and until the process of stuffing the pillow is complete, whereupon the maker closes the zipper or other closure device.

The result of this method is a pillow of arbitrary shape, with soft edges and no external seams or hardware, and the pillow is of varying thickness and can be easily constructed with a variety of fill densities.

In accordance with another aspect of the disclosure, there is provided a pillow having varying levels of sustainable thickness or taper along at least one, or even multiple, dimensions of the pillow, comprising: a top pillow cover comprising an inside surface, an outside surface, and a perimeter; a bottom pillow cover comprising an inside surface, an outside surface, and a perimeter, said top pillow cover and said bottom pillow cover being interconnected with an interconnecting member; a first portion of at least one interconnectible thickness controlling member attached to the inside surface of the top pillow cover; a second portion of the at least one interconnectible thickness controlling member attached to the inside surface of the bottom pillow cover and interconnected with the portion of the interconnectible thickness controlling member attached to the inside surface of the top pillow cover. It will be appreciated that the top pillow cover and the bottom pillow cover may be each of a material suitable as a pillow liner, and in such case the pillow may further comprise an additional pillow covering.

The pillow in accordance with this aspect and embodiment of the disclosure further comprises a fill material retained within the pillow and held in place with the at least one interconnectible thickness controlling member, the at least one interconnectible thickness controlling member defining in effect a baffle relative to the fill material enabling varying levels of sustainable thickness or taper along the at least one dimension of the pillow, wherein one portion of the pillow is filled to a given thickness or taper along a length or width of the pillow and another portion of the pillow is filled to another thickness or taper along another length of the pillow. Thus, the transition from the given thickness or taper to the another thickness or taper is controlled by at least one intermediate interconnectible thickness controlling member since the combined length of the ribbon pair when connected, minus the portion designated for sewing to the top or bottom pillow cover, will be the thickness of the pillow at that location (together with some possible flexibility, or stretch give, in the ribbon portions). The thickness, or alternatively the taper, is sustainable as disclosed because the interconnectible thickness controlling member portions are provided so as to be of a consistent length such that same-length such member portions may be implemented along a length or width of pillow (for sustainable thickness) and/or different-length such member portions may be implemented along a length or width of pillow (for sustainable taper).

Further, in accordance with this aspect and embodiment of the disclosure, there is provided a closeable opening in the pillow having allowed access to the interior of the pillow.

In accordance with an embodiment of this aspect of the disclosure, the pillow may be adapted for use as a body pillow, wherein each the top pillow cover and the bottom pillow cover are of a length corresponding roughly to the length of a human body, and wherein the at least one interconnectible thickness controlling member comprises a plurality of interconnectible ribbons, each interconnectible ribbon being attached at a different location lengthwise and widthwise of the pillow. In this embodiment, each interconnectible ribbon is preferably of adjustable length during manufacture and adapted to maintain at least one of variable thickness and fill density of the pillow along a dimension of the pillow adaptable to cushioning varying portions of the human body such as chest, abdomen, hips, knees, thighs, and ankles.

The pillow in accordance with this aspect of the disclosure may be either a knife-edge type pillow or a box-type pillow. Thus, in the case of a box-type pillow, the interconnecting member comprises attaching an elongated interconnecting edge cover along the perimeter of each of the top pillow cover and the bottom pillow cover, and wherein the closeable opening in the pillow may further comprise installing a zipper into the elongated interconnecting edge cover. It will be appreciated that the zipper opening in the side of the pillow, or in another location on the pillow, whether in the elongated interconnecting edge cover, or in the case of a knife-edge construction pillow, may be opened and closed by other means, such as snaps, buttons or hook-and-pile fasteners without departing from the spirit o the invention as claimed.

In accordance with an embodiment of this aspect of the disclosure, the first portion of the interconnectible thickness controlling member comprises a hook sewn thereon, such as may be the case where a g-hook is sewn onto a ribbon portion, and the second portion of the interconnectible thickness controlling member comprises a loop sewn therein. In this embodiment, therefore, the hook and the loop are interconnected within the pillow to enable variable thickness or variable taper areas along one or more dimensions of the pillow. Note that such variable thickness or variable taper may be accomplished either with a longer ribbon attached (e.g., adhered with adhesive or sewn) to the inner surfaces of the top and bottom pillow covers, or with multiple loops along a length of ribbon such that a maker could create shorter interconnectible thickness controlling members by hooking the g-hook to a loop that is higher, or closer to the inner surface of the pillow cover. In this way, the maker is enabled in making a less thick portion of the pillow, and the maker can repeat this step multiple times for longer less thick portions of the pillow.

Preferably, in accordance with an embodiment of one or more aspects of the disclosure, the pillow preferably comprises a plurality of interconnectible thickness controlling members, each comprised of a first somewhat flexible portion sewn to the inside surface of the top pillow cover and a corresponding second somewhat flexible portion sewn to the inside surface of the bottom pillow cover, each of the first somewhat flexible portion and the second somewhat flexible portion having a portion of an interconnecting member comprised of one of a single hook and loop portions, snap and receptacle portions, multiple hook and loop portions, hook and pile portions, touch fasteners, stick and loop portions, and g-hook and sewn-in loop portions, adapted for interconnecting the corresponding interconnectible thickness controlling member portions. In embodiments the interconnectible thickness controlling member, or ribbon material, may comprise grosgrain webbing or other strong, pliable fabric or material. In the case of a hook-and-pile fastener for interconnecting two ribbons of an interconnectible thickness controlling member, the hook portion of the fastener may be sewn onto the end of one of the ribbons, and the pile portion of the fastener may be sewn onto the end of the other ribbon.

In accordance with a preferred embodiment of this aspect of the disclosure, whether considering a knife-edge pillow or a box-type construction pillow, there is preferably provided a pillow wherein the top pillow cover and the bottom pillow cover are interconnected with an interconnecting member with internal hidden seams.

These embodiments of the disclosure thus provide for longer, or wider, pillows having tapers, varying levels of thickness (some perhaps longer sections of a thinner area combined with some shorter sections of a thicker area, or vice-versa), and/or varying density fill characteristics from one area of the pillow to another, all to enable creation of a soft and comfortable pillow having adequate cushioning for body areas, such as bony knees, requiring additional cushioning, and to further enable creation of more densely filled areas, such as in a region of the pillow corresponding to a user's chest area to facilitate side sleeping without the chest structure of the user collapsing unduly. This in turn will lead to better rest, restoration, and healing of users.

In another embodiment of the disclosure, the pillow may comprise a top and bottom pillow cover, plus the addition of side panels to give a more box-like shape to the pillow, rather than the knife-edge construction as described. The zipper opening is sewn into one section of the side panel. Since all seams are sewn while the pillow is in the 'inside-out' configuration, there are no external seams and the softness of the pillow is preserved.

Of course, it will be appreciated that the fill material used may comprise sand or pellets of natural or synthetic material in order to achieve the desired fill density, and the pillow may serve a variety of purposes, such as a horseshoe-shaped neck pillow, a chiropractic type head and neck support pillow, a body pillow, or any type of box-shaped pillow needing portions with differing thicknesses.

Thus, in accordance with one or more aspects and embodiments of the disclosure, a pillow constructed by one or more of the above-described methods is suitable for use as a body pillow and preferably comprises: a wide section of sufficient size and thickness controlled by one or more interconnectible thickness thickness controlling members to be comfortable when hugged to the chest of a person, supporting the elbows and arms in natural positions; a narrow and thinner section for passing in front of the hips of the person where less cushioning is needed; a wider and thicker section controlled by one or more interconnectible thickness controlling members for passing between the thighs and knees of the person, providing substantial cushioning especially for the knees; a thinner section controlled by one or more interconnectible thickness controlling members for passing between the ankles of the person, allowing freedom of movement and a moderate amount of cushioning.

Thus, in each of the sections of the pillow with varying thickness, the thickness of the pillow is controlled by internal connected ribbon pairs otherwise known as interconnectible thickness controlling members. Further, each of the sections of the pillow may be constructed with varying degree of density of fill to accommodate different needs at different portions of the body. For example, the fill at the chest region and at the knees region may be more dense to support breathing (at the chest region) and separation (at the knees portion), whereas the portions at the lower abdomen and at the calves may be less dense for greater comfort.

It will be appreciated by those skilled in the art that there are various possible combinations of the above-described elements and sub-elements for various embodiments of the disclosure, whether such elements and sub-elements be combined in whole or in part, which may be employed without departing from the scope and spirit of the invention as claimed.

The subject matter of the present disclosure is particularly pointed out and distinctly claimed in the concluding portion of this specification. However, both the organization and method of operation, together with further advantages and objects thereof, may best be understood by reference to the following descriptions taken in connection with accompanying drawings wherein like reference characters refer to like elements.

BRIEF DESCRIPTION OF THE DRAWINGS

FIG. 4A is a perspective view of an inside-out pillow casing and therefore the inner surface of its top pillow cover, with a bottom pillow cover (not shown on the back side of the pillow in FIG. 4A, but shown in FIG. 4B), with the outer surfaces of the pillow covers adjacent to each other and aligned and having peripheral, normally hidden, seams sewn around the edge of the pillow, showing the ribbons with g-hooks attached on the inside of the top cover and a representative location for a zipper;

FIG. 4B is a perspective view of the back side, and therefore the inside of the bottom pillow cover, of the pillow of FIG. 4A, with sewn loops attached in locations on the inside of the bottom pillow cover corresponding to the ribbons with g-hooks shown in FIG. 4A, and aligned with the top pillow cover of FIG. 4A;

FIG. 4C is a perspective view of pieces of an elongated interconnecting edge cover of varying widths along its length and suitable for sewing with hidden seams between top and bottom pillow cover portions as known for a box-type construction pillow of FIGS. 4A and 4B;

DETAILED DESCRIPTION

Figure 1:
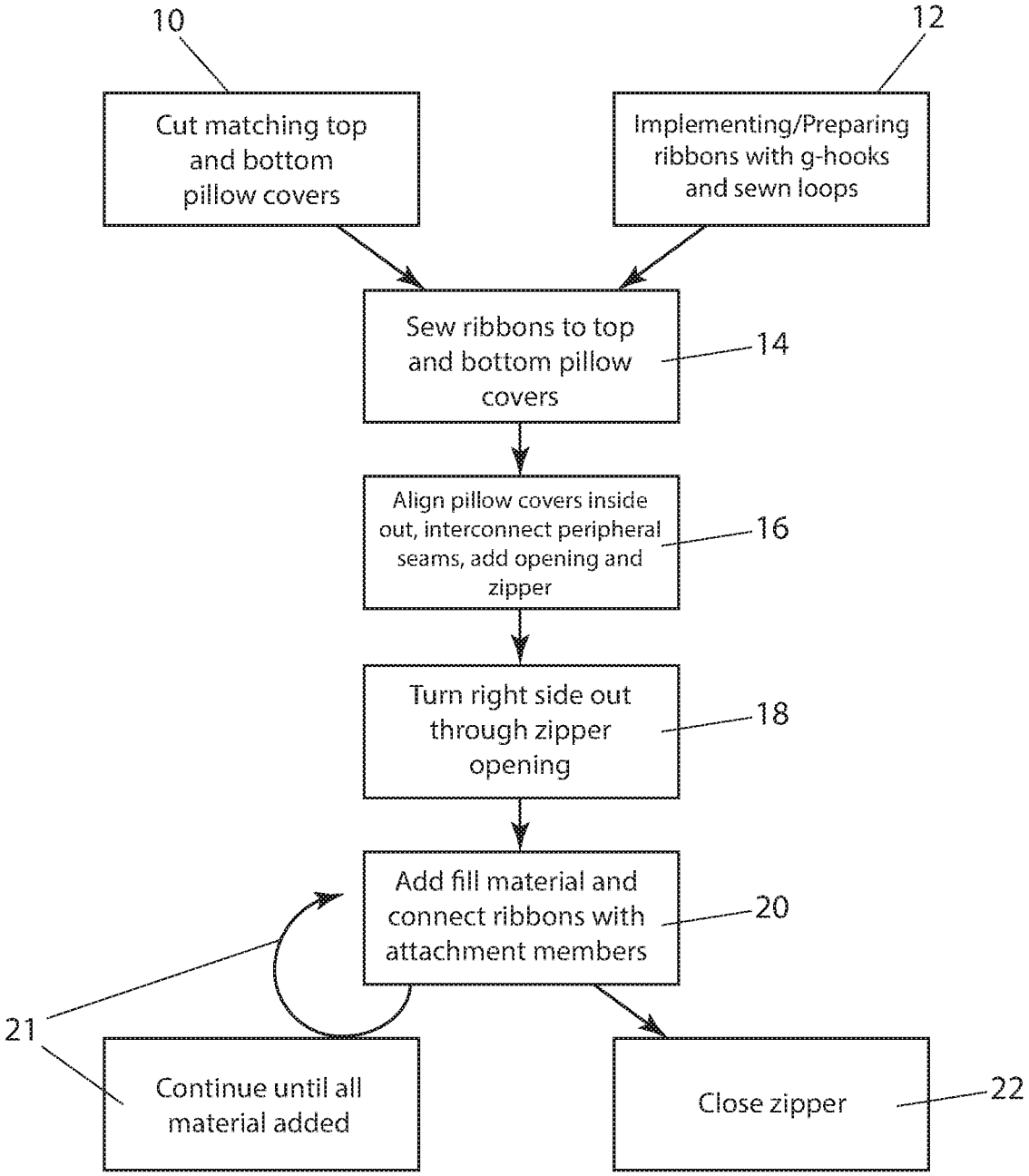
FIG. 1 is a flowchart showing the general steps involved in constructing a pillow in accordance with the disclosure.

Referring to the Figures, and in particular FIG. 1, in accordance with one or more aspects of the disclosure, there is provided a method for constructing a pillow (e.g., pillow 126 shown in FIGS. 4A, 4B, 6, and 9) of arbitrary shape, varying thickness, and varying densities along the length of the pillow, comprising the steps outlined generally in FIG. 1.

There are provided side-by-side steps (indicating no particular order for these steps) of step 10 cutting material in a desired shape to produce a top pillow cover 100 and a bottom pillow cover 102; and step 12 (comprising two substeps) (1) implementing a first portion of an interconnecting member 104 (e.g., a g-hook 104) with a first portion of an interconnectible thickness controlling member 108 (e.g., ribbons 108), and (2) implementing a second portion of the interconnecting member 106 (e.g., a loop 106) with another portion of the interconnectible thickness controlling member 108 (e.g., ribbons 108), wherein a combined length of the first and second portions of the interconnectible thickness controlling member connected together is adapted for controlling of a desired thickness of the pillow 126 at a given location on the pillow. As indicated at step 12, "Implementing/Preparing ribbons with g-hooks and sewn loops", this step 12 may be repeated multiple times for multiple interconnecting member portions 108 (such as with 24 multiple ribbons as shown in FIGS. 4A and 4B).

Step 14 comprises attaching (e.g., by sewing) the first portion of the interconnectible thickness controlling member 108 (ribbon 108) with the first portion of the interconnecting member (hook 104) to an inner surface of the top pillow cover 100 and attaching (e.g., by sewing) the another portion of the interconnectible thickness controlling member 108 (ribbon 108) with the second portion of the interconnecting member (loop, or loops, 106) to an inner surface of the bottom pillow cover 102 in a location adapted to be across from and corresponding with the portion of the interconnectible thickness controlling member 108 attached with the first portion of the interconnecting member 104 attached to the top pillow cover 100—as indicated in that step 14 refers to "sewing ribbons", the step 14 may be repeated for as many interconnectible thickness controlling member portions 108 as are desired (e.g., in the case of pillow 126 of FIG. there are shown 12 pairs of interconnectible thickness controlling member portions (i.e., 12 interconnected combinations 110, 110')).

Step 16 is comprised of 4 substeps: (1) aligning the top pillow cover 100 and the bottom pillow cover 102 with the outside surface of each cover facing each other (i.e., inside out) so as to be adapted to enclosing of the pillow 126, (2) interconnecting peripheral seams 113 of the pillow 126, as with thread or an elongated interconnecting member(s) 120 as shown in FIG. 4C; (3) creating/adding an opening 118 for the pillow, and (4) adding a zipper 119 to the opening 118, making it a closeable opening 118, 119.

Figure 4D:
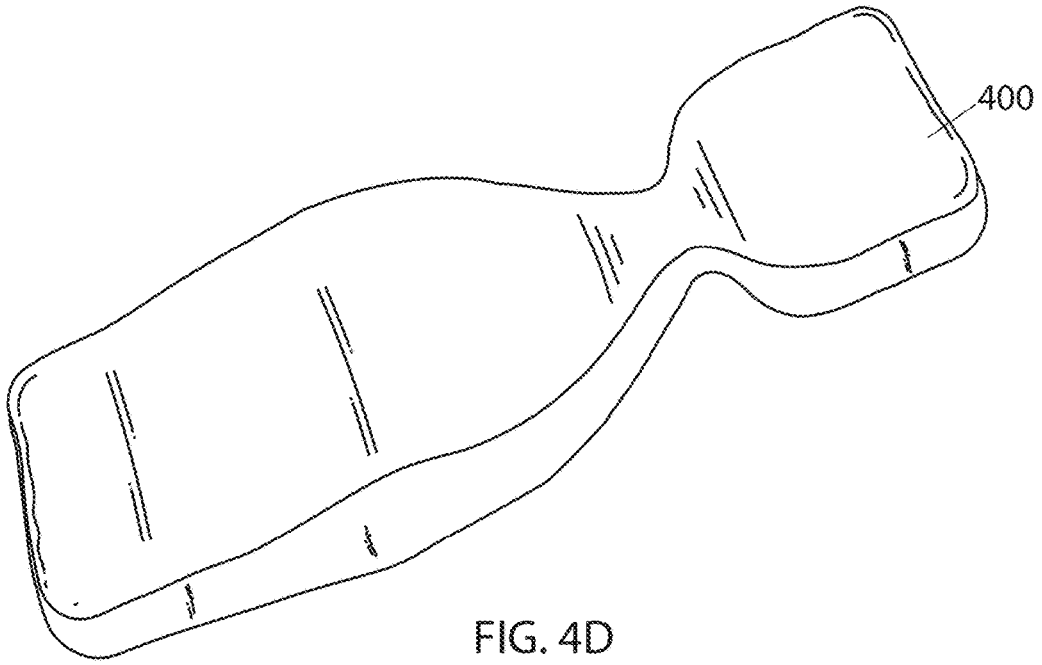
FIG. 4D is a perspective view of an additional pillow covering for a body pillow hereof.

The step 16 (2), interconnecting the top pillow cover 100 and the bottom pillow cover 102 along corresponding perimeters 113 of the covers may be accomplished with an interconnecting member such as thread 121 (FIG. 6) sewing in a hidden seam, or such as by using an elongated interconnecting member, or panel, which may be comprised of a plurality of panel members 120 as shown in FIG. 4C. Either way, preferably there are employed what are considered to be more comfortable hidden seams with the pillow 126 and such as may be used for either a knife-edge-type pillow construction or a box pillow-type construction. When using box pillow-type construction, step 16 (2), interconnecting the top pillow cover 100 and the bottom pillow cover 102, thus preferably further comprises sewing an elongated interconnecting edge cover 120, or in accordance with FIG. 4C a plurality of such elongated interconnecting edge covers 120, along the perimeters 113 of each the top pillow cover and the bottom pillow cover. It will be appreciated that the top pillow cover 100 and the bottom pillow cover 102 may be each of a material suitable as a pillow liner, and in such case the pillow may further comprise an additional pillow covering 400.

The closeable opening 118, 119 of substeps 16 (3) and (4) may also be applied to either a knife-edge-type pillow (preferably at a seam of the pillow), or a box-construction-type pillow 126. Applied to a knife-edge-type pillow, these substeps 16 (3) and (4) may also be referred to as associating the closeable opening 118, 119 with the pillow, for example by creating an opening 118 and sewing a zipper 119 at an intersection of corresponding peripheral locations of the top pillow cover 100 and the bottom pillow cover 102. Or, for a box-construction-type pillow 126, these substeps 16 (3) and (4) may be referred to as associating the closeable opening 118, 119 with the pillow, for example, by creating an opening 118 in the elongated interconnecting edge cover 120, and installing a zipper 119 at the opening 118, both preferably before sewing the elongated interconnecting edge cover to the top pillow cover 100 and the bottom pillow cover 102. The steps 16 (3) and (4) make the closeable opening 118, 119 adapted to facilitate filling the pillow 126 with fill through the closeable opening.

Step 18 comprises turning the pillow right side out through the opening 118 such that the interconnectible.

Step 20 comprises two substeps (1) adding fill material 116 to the inside of the pillow 126 through the closeable opening 118, 119 and behind (relative to the closeable opening 118, 119) corresponding first and second portions 108 of interconnecting members (ribbon pairs) 110; and (2) interconnecting to form an interconnected combination 110 of ribbon pairs 108, the first interconnecting portion of the interconnecting member (e.g., hook 104) to the second portion of the interconnecting member (e.g., one of the loops 106) at the interior of the pillow 126, such that the interconnected combination 110 is located in front (relative to the closeable opening) of the fill material 116. As shown at step 20, and at repeating indicator 21, there is provided a plurality of repeated steps adding fiber fill material 116 to the inside of the pillow 126 through the closeable opening 118, 119 and in front (relative to the opening) of the interconnected combination (i.e., repeating step 20 as shown at 21), until the pillow if filled completely, each portion of the pillow behind an interconnected combination 110 optionally being filled to a higher density than another portion of the pillow behind an interconnection combination 110.

Step 22 comprises closing the closeable opening 118, 119 as with zipping the opening so as to close the closeable opening.

Figure 10A:
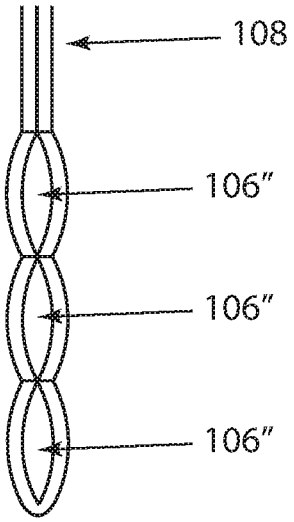
FIG. 10A is a side view of an alternative embodiment of another interconnectible thickness controlling member wherein loops are implemented by sewing them inline in the member.
Figure 10B:
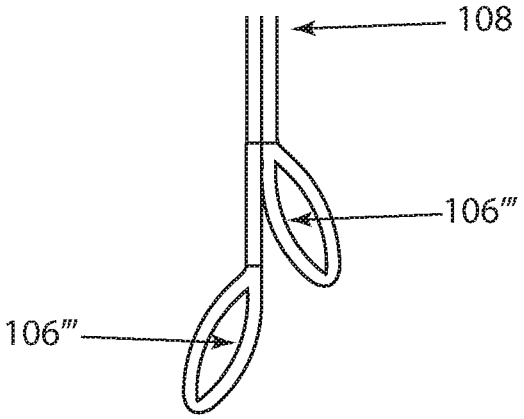
FIG. 10B is a side view of another alternative embodiment of another interconnectible thickness controlling member wherein the loops are implemented by sewing them on opposite sides of the member.

In accordance with an embodiment of the pillow 126, either or both the first portion 108 of the interconnectible thickness controlling member (interconnected combination 110) and/or the second portion 108 of the interconnectible thickness controlling member, comprises a ribbon portion 108, such as a first ribbon portion and/or a second ribbon portion. Further, in accordance with an embodiment, the first portion of the interconnecting member preferably comprises a hook 104, and the second portion of the interconnecting member preferably comprises one of a plurality of loops 106", each of the plurality of loops 106" being located at different height locations along a ribbon portion 108. Thus, as shown in FIG. 10A, there is provided a side view of an alternative embodiment of another interconnectible thickness controlling member 108, wherein loops 106" are implemented by sewing them inline in the member. Further, as shown in FIG. 10B there is provided is a side view another alternative embodiment of another interconnectible thickness controlling member 108 wherein loops 106'" are implemented by sewing them on opposite sides of the member.

Thus, in accordance with an embodiment, the implementing a first portion step 12 (1) comprises attaching the first ribbon 108 portion to a hook 104, wherein the implementing a second portion step 12 (2) comprises forming at least one loop 106", 106'" in the another ribbon portion 108. Further, in accordance with an embodiment, the attaching the first ribbon portion 108 of step 14 comprises attaching (sewing) the first ribbon portion 108 with the hook 104 to the inner surface of the top pillow cover 100, and the attaching the another portion 108 of step 14 comprises attaching the another ribbon portion 108 with the loop(s) 106", 106'" to the inner surface of the bottom pillow 102. It will be appreciated that throughout the disclosure that any portion of the disclosure that refers to interconnectible thickness control/controlling members 108 or an interconnected combination 110, such may also be appropriately referred to as a ribbon pair 110.

Preferably, in accordance with an embodiment, the implementing step 12 (applied in this embodiment to implementing/attaching hooks 104 and implementing/attaching loops 106 to ribbons 108), and the attaching the first portion step 14, and the attaching the another portion step 14, are repeated such that a plurality of ribbon portions 108, 108' with hooks 104, 104' and a corresponding plurality of ribbon portions 108 with loops 106, 106', 106", 106'", are each attached (in successive repeated attachments) correspondingly to different locations on the inner surface of the top pillow cover 100 and the inner surface of the bottom pillow cover 102, respectively.

Figure 8:
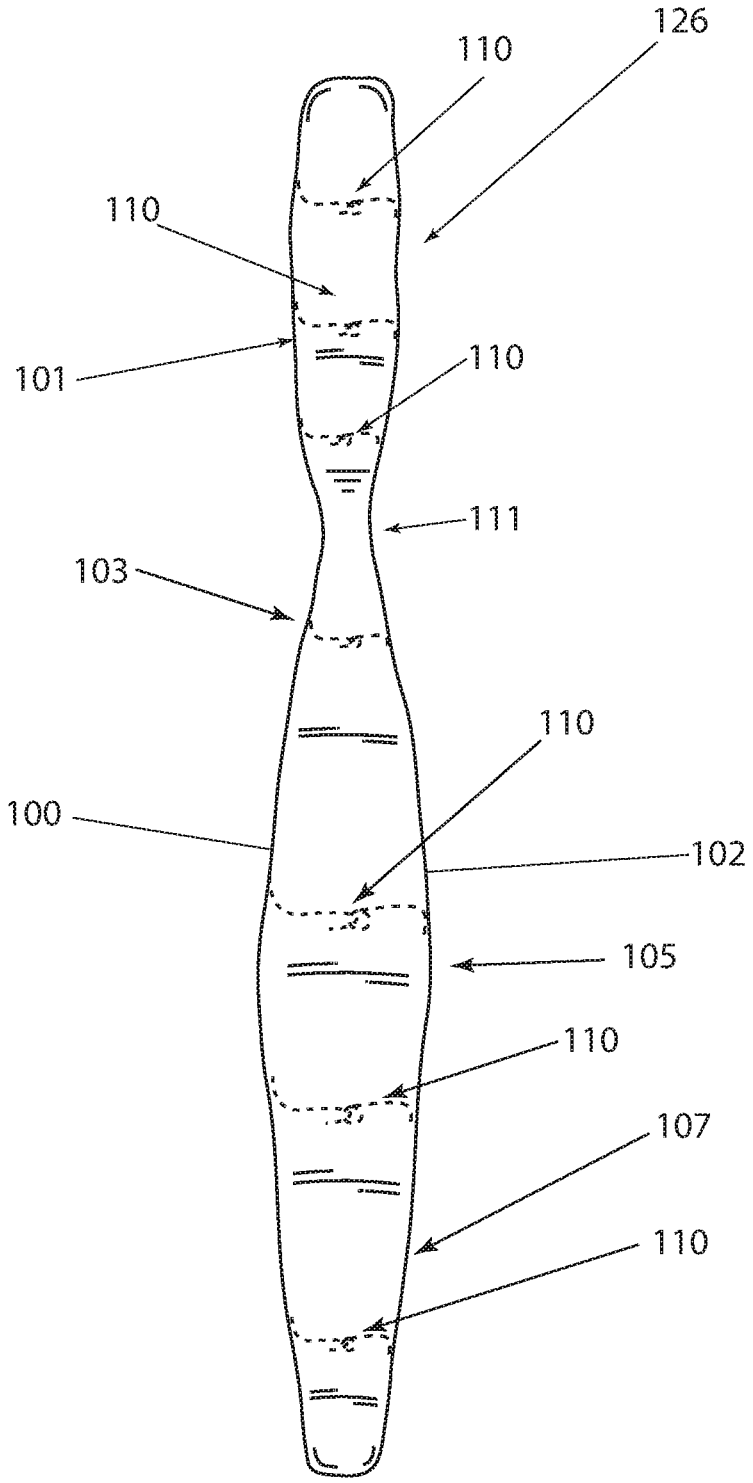
FIG. 8 is a side view of a completed body pillow, showing an example of the variety of thicknesses achievable in constructing the pillow in accordance with the methods and teaching of the disclosure.
Figure 9:
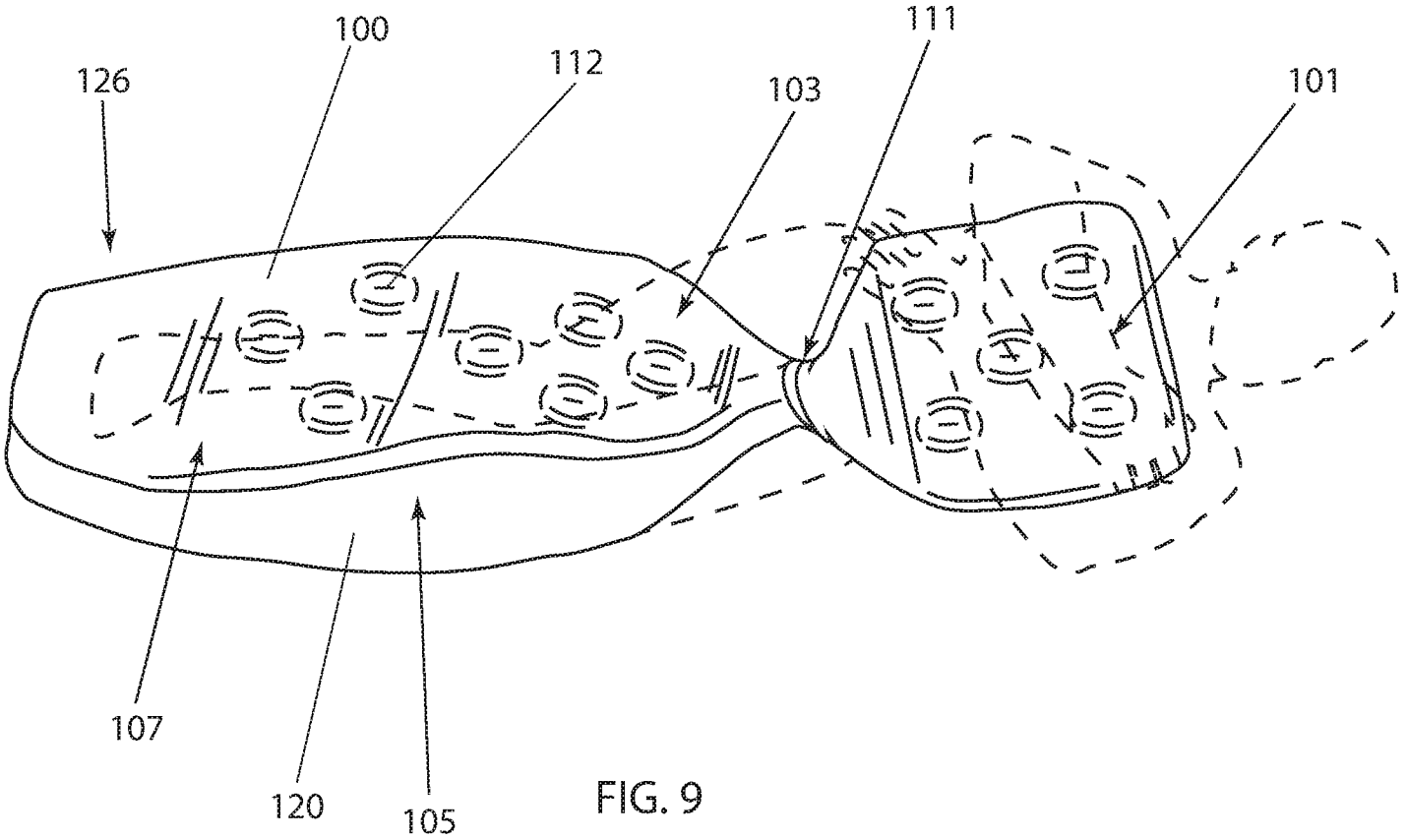
FIG. 9 is a partial perspective view of a particular design of a body pillow, showing the position of a person using the pillow in a reclining position, and showing the variation in shape and thickness, as well as varying density portions, adapted to cushioning various parts of a human body.

Further, preferably each adding fiber fill material 116 to the inside of the pillow 126 in step 20, and each interconnecting portions 108 to form an interconnected combination 110 in step 20, are each repeated as necessary to complete filling different locations of the pillow 126 and adapted for facilitating at least one of a plurality of pillow thickness changes and optionally a plurality of fill density changes along one or more dimensions of the pillow as shown in FIGS. 8 and 9.

Still further, in accordance with an embodiment, there is provided that each implementing a second portion step 12 comprises forming a plurality of loops 106', 106", 106'" in each of the plurality of another portion/ribbon strips 108, such that the length of each interconnected combination 110 may be differently adapted with differently-positioned, different-height, plurality of loops 106", 106'", to facilitate producing a pillow 126 with variable thicknesses, tapers, and/or densities along the length or width of the pillow.

Preferably, each hook 104 in accordance with one or more embodiments of a pillow 126 comprises a g-shaped hook 104, e.g., a g-hook, and each interconnecting to form an interconnected combinations 110 as part of substep 20 (2) comprises manually hooking such a g-hook 104 with a loop 106, 106', 106", 106'", and each of a plurality of loops is sewn into each another ribbon 108 to allow for differing length interconnected combinations 110 using the same first ribbon portions 108 with a g-hook 106 and the same another ribbon portions 108 with the plurality of loops 106, depending on which of the plurality of loops a particular g-hook is hooked into.

In this way, the maker is enabled in easily varying the length of the interconnected combination 110 to establish varying, new, different tapers, and/or levels, of fill along a length or width dimension of the pillow 126 as desired.

Preferably, in accordance with an embodiment of the pillow 126, the closeable opening 118 in the pillow 126 is secured with a zipper 119 sewn between the top pillow cover 100 and the bottom pillow cover 102 such that the closing the enclosure step 22 further comprises closing the zipper 118.

Further, preferably, the pillow 126 is hand-filled with fiber fill 116. However, it will be appreciated by those skilled in the art that the step of adding the fill material may just as well comprise pouring of sand, pellets, or other fill material, whether by hand or with a machine, for pouring filling material to the inside of the pillow, without departing from the broader aspects of the invention and as claimed, except in such a case while filling the pillow may be automated and quicker to complete, variable densities may not be as easily accomplished in such case, since sand or pellets may tend to flow more easily around a particular interconnected combination 110, whereas fiber fill 116 would be more likely to be successfully held in place by a particular interconnected combination 110.

The aforementioned methods aspect of the disclosure provide a variable-thickness and/or tapered pillow 126, whether a conventional pillow, a specialty pillow, or a body pillow, that is adaptable to be filled to varying densities along the length or width of the pillow and that is adaptable to include varying levels of thickness and/or taper (e.g., as at areas 101, 103, 105, 107, 111 of FIGS. 8 and 9) along the length and/or width of the pillow so as to be able to adequately cushion varying portions of a person's body, or otherwise. Though not shown, an interconnected combination 110 may be implemented at area 111, or alternatively thickness and density at this particular location may be controlled between areas 101 and 103 at either end of area 111 such that twisting of this area may be more readily implemented as in the case where the body pillow 126 is used by a user as shown in FIG. 9 with upper and lower portions of the pillow being shown at substantially right angles to each other during use.

Figure 2:
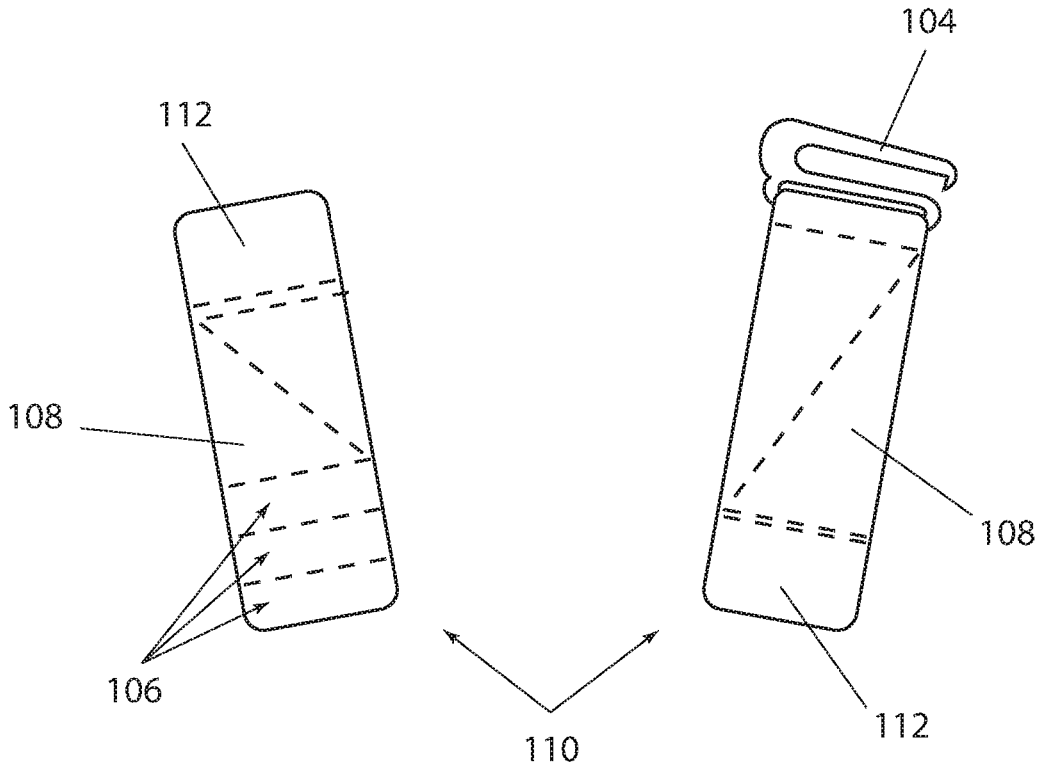
FIG. 2 is a representative top view of two interconnectible thickness control members (when connected together forming an interconnected combination), namely in this embodiment comprising ribbons forming a ribbon pair, showing one ribbon attached to a g-hook, and the other ribbon folded over and sewn to create a plurality of loops for inserting the open portion of the g-hook, each with a ribbon attachment zone for sewing to the top and bottom pillow cover, respectively.

Accordingly, the method for constructing a pillow 126 of arbitrary shape and thickness, comprises the following steps:

a. Step 10, cut material for the top and bottom pillow covers 100, 102 in the desired shape;

b. Step 12, implementing/preparing one or more, preferably a plurality of pairs of ribbons 108 of fabric (in a repetitive subprocess for a plurality of pairs of ribbons) to be used as internal attachment points within the pillow 126. As part of this implementing/preparing step, for each of half of the ribbons 108, attach a g-hook 104 by looping an end of the ribbon through the closed portion of the g-hook and sewing the end of the ribbon to a body portion of the ribbon. For each of the other half of the ribbons 108, create at least one loop 106 by folding the ribbon and sewing an end of the ribbon to the body of the ribbon, it being the case that this step of sewing a loop into the ribbon may be repeated multiple times within a single ribbon in order to provide different levels of loops 106 as shown for example in FIG. 2, within one of which to hook an open portion of the g-hook 104. For each ribbon with a hook or loop, designate a portion of the ribbon on the end opposite the g-hook or the loop as the area to be sewn to the inside of the top or bottom pillow cover 100, 102, referred to as a ribbon attachment zone 112 (FIG. 2). Thus, ribbon pairs 108, also known as an interconnected combinations 110, will consist of one ribbon 108 attached to a g-hook 104 and one ribbon 108 with at least one sewn loop 106.

c. Step 14, further, then, wherein a plurality of interconnected combinations 110, or ribbon pairs 110, are employed in an embodiment of pillow 126, at each desired location or locations on the pillow where the thickness will be controlled by the ribbon pairs, the user may sew the ribbon attachment zone 112 of one ribbon of the ribbon pair to the top pillow cover 100 on the side that will become the inside of the pillow and then sew the ribbon attachment zone 112 of the other ribbon of the ribbon pair to a corresponding location on the bottom pillow cover 102, on the side that will become the inside of the pillow. Thus, the ribbon pairs 108 are sewn to inner surfaces of the top and bottom pillow covers 100, 102, respectively, at corresponding locations preferably directly across from each other.

d. Step 16, after all ribbons 108 have thus been attached to the top and bottom pillow covers 100, 102, the user is advised to position the top and bottom pillow covers one on top of the other with what will become the outer surfaces of the pillow covers adjacent to each other, and to sew peripheral seams 113 around the edges of the pillow covers (in the case of a knife-edge pillow design), or to sew peripheral sems 113 around the edges of the pillow covers and an elongated interconnecting edge member 120 (in the case of a box-type pillow design), including a section for a zippered or other closeable opening 118, 119.

e. Step 18, turn the interconnected (sewn together) top and bottom pillow covers 100, 102 right side out by utilizing the zippered opening, such that the ribbons with g-hooks and sewn loops will now be on the inside of the pillow 126, but not yet connected.

f. Step 20, stuff/fill the pillow 126 preferably by hand with the desired fill material 116 through the zippered opening 118, 119 and starting with the portions of the pillow farthest from the opening. As the fill material 116 reaches the locations of the ribbon pairs 110, connect the g-hooks 104 to the sewn loops 106, ensuring control of the thickness of the pillow 126 at that point. The fill density is determined by the amount of filling 116 inserted, and this is controlled at the time of manufacture.

g. Step 21, continue stuffing the pillow 126 and connecting the ribbon pairs 110 as the filling moves closer to the zipper opening 118, 119 and until the process of stuffing the pillow 126 is complete;

h. Step 22, closing the closeable opening 118, for example the zipper 119.

The result of this method is a pillow 126 of arbitrary shape, with soft edges 113 and no external seams or hardware (except a low-profile zipper with a actuating attachment folded preferably under a fabric cover as known). Such a pillow 126 may be of varying thickness, and it can be easily constructed with a variety of fill densities.

In accordance with an embodiment shown in FIGS. 4A and 4B, and in accordance with the method steps outlined in this disclosure, there is provided a pillow 126 comprising a top pillow cover 100 adapted by means of attachment of one or more ribbons 108 with attached g-hooks 104, and a bottom pillow cover 102 adapted by means of attachment of one or more ribbons 108 with sewn loops 106, with the top pillow cover and bottom pillow cover sewn together "inside out" with a peripheral seam 114, and including a closeable member, such as a zipper 119. The zipper 119, when open, provides a closeable opening 118 to allow the turning of the pillow 126 "right side out" and to stuff the fill material 116 into the pillow. The peripheral seam 114 may join the top pillow cover 100 directly with the bottom pillow cover 102, resulting in a pillow with a tapered edge, commonly referred to as a "knife edge pillow". Or, optionally, preferably, a side panel 120 (or multiple side panels 120) may be inserted where the top pillow cover 100 is sewn to one edge of the side panel 120, and the bottom pillow cover 102 is sewn to the other edge, resulting in a more square edge, commonly referred to as a "box-construction-type pillow". In either case, all seams 114 are preferably internal to the pillow after it is turned "right side out".

Figure 3:
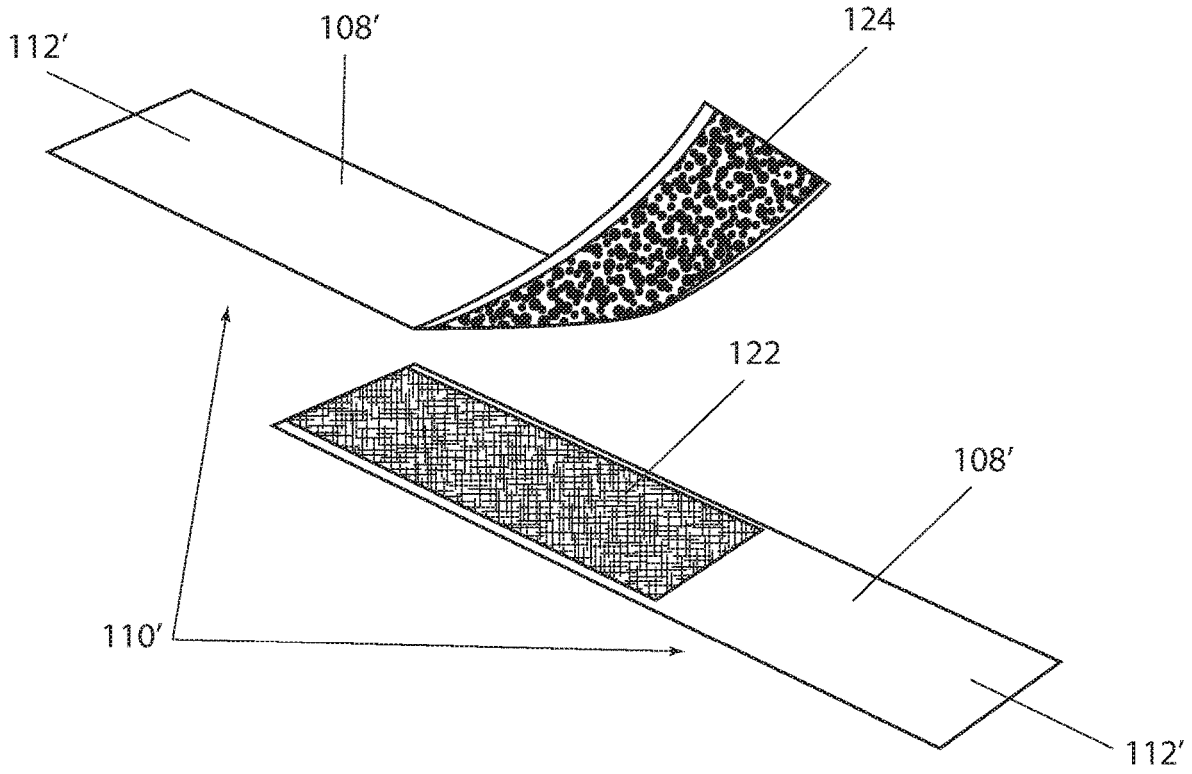
FIG. 3 is a representative perspective view of two ribbons comprising a ribbon pair, with the hook portion of a hook-and-pile (aka hook-and-loop) fastener attached to one ribbon and the pile portion of a hook-and-pile fastener attached to the other ribbon, as an alternative method of connecting the two ribbons into a ribbon pair or an interconnected combination.

Referring to FIG. 2, interconnectible thickness controlling member portions 108, combined to form interconnected combinations 110, aka ribbon pairs 110, comprise one first ribbon 108 with an attached g-hook 104, the length of the ribbon being sufficient to provide a ribbon attachment zone 112 that will be sewn to the top pillow cover 100, and a second ribbon 108 that has been folded and sewn to provide a plurality of different-level sewn loops 106 that may be connected to the g-hook during construction of the pillow 126, the length of the second ribbon also being sufficient to provide a ribbon attachment zone 112 that will be sewn to the bottom pillow cover 102. It will be noted that the thickness of the pillow 126 at the point where the ribbons 108 are attached to the top and bottom covers 100, 102, will be determined by the length of the two ribbons in the ribbon pair 110 (preferably with some stretching of each ribbon portion 108 adapted for returning to an unstretched position), allowing the pillow to have varying thickness (as shown at 101, 103, 105, 107, 111) where different ribbon pairs 108 may be of different lengths, attached at different loops 106, or otherwise variably attached as with a hook-and-pile fastener as shown in FIG. 3.

In accordance with another embodiment of the disclosure, the two ribbons 108' of a ribbon pair 110 may be connected using a hook-and-pile fastener, where the hook portion 122 is sewn or attached to one ribbon 108' and the pile portion 124 is sewn or attached to the other ribbon 108'. The ribbon pairs 110, 110' are preferably attached to the top pillow cover 100 and bottom pillow cover 102 by means of sewing at the respective ribbon attachment zone 112, 112'.

Figure 5:
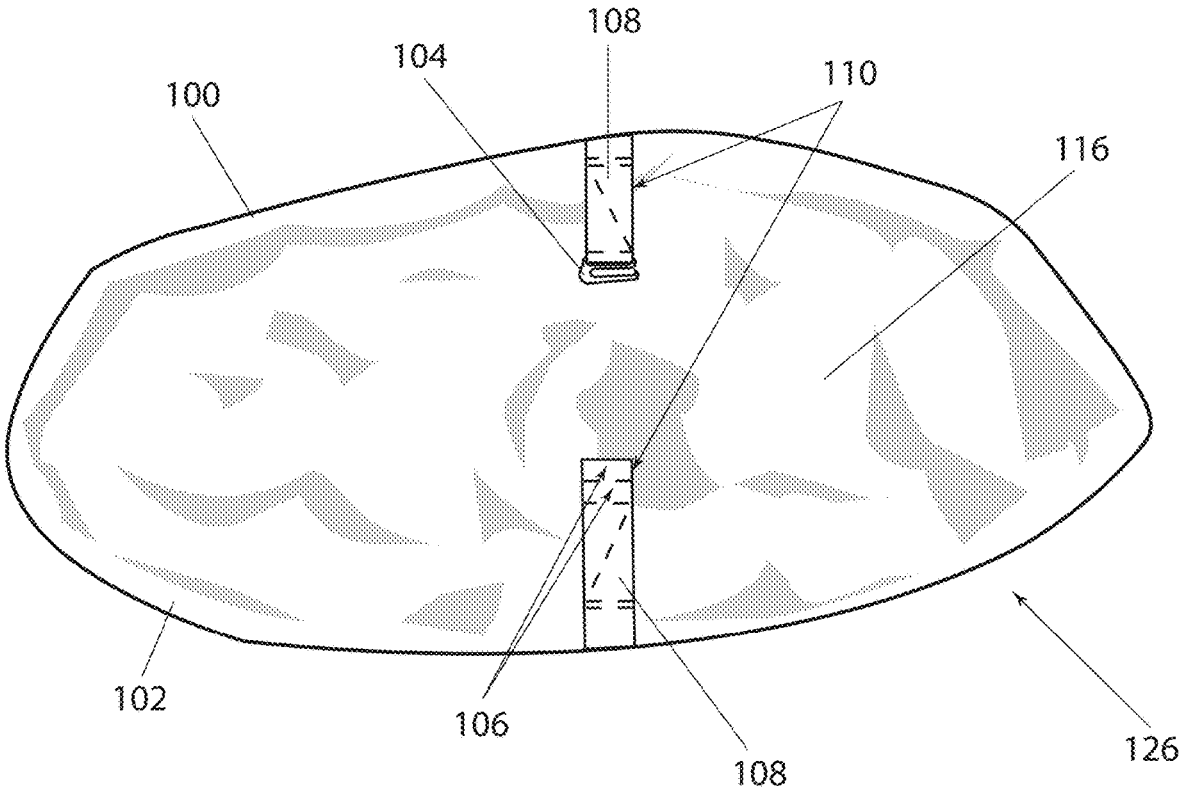
FIG. 5 is a representation of the inside of a pillow being stuffed with fill material, and the two ribbons of a ribbon pair (interconnectible thickness controlling member portions, or interconnected combination) in position to be connected to secure the top pillow cover to the bottom pillow cover with a desired thickness at that location.

Referring specifically to FIG. 5, fill material 116 is placed, preferably by hand, but otherwise possibly by machine as well without departing from the spirit of the invention as claimed, into the pillow 126 and has filled the pillow to the location of just behind a ribbon pair 110 (behind from the perspective of the opening), at which time the two ribbons 108 of the ribbon pair may be connected by means of the g-hook 104 and sewn loop 106. The process of placing fill material 116 into the pillow 126 and connecting the two ribbons 108 of each ribbon pair 110 continues until the pillow has been filled. Thus, it will be appreciated that next the fill material 116 will be placed in front of the two ribbons 108 of each ribbon pair 110 (in front from the perspective of the closeable opening 118, 119), until the next ribbons (a single set of ribbon pairs or a plurality of such) have been reached, at which time the next ribbons may be connected (preferably by hand) as previously described, and so on, until the pillow 126 is completely filled.

Figure 6:
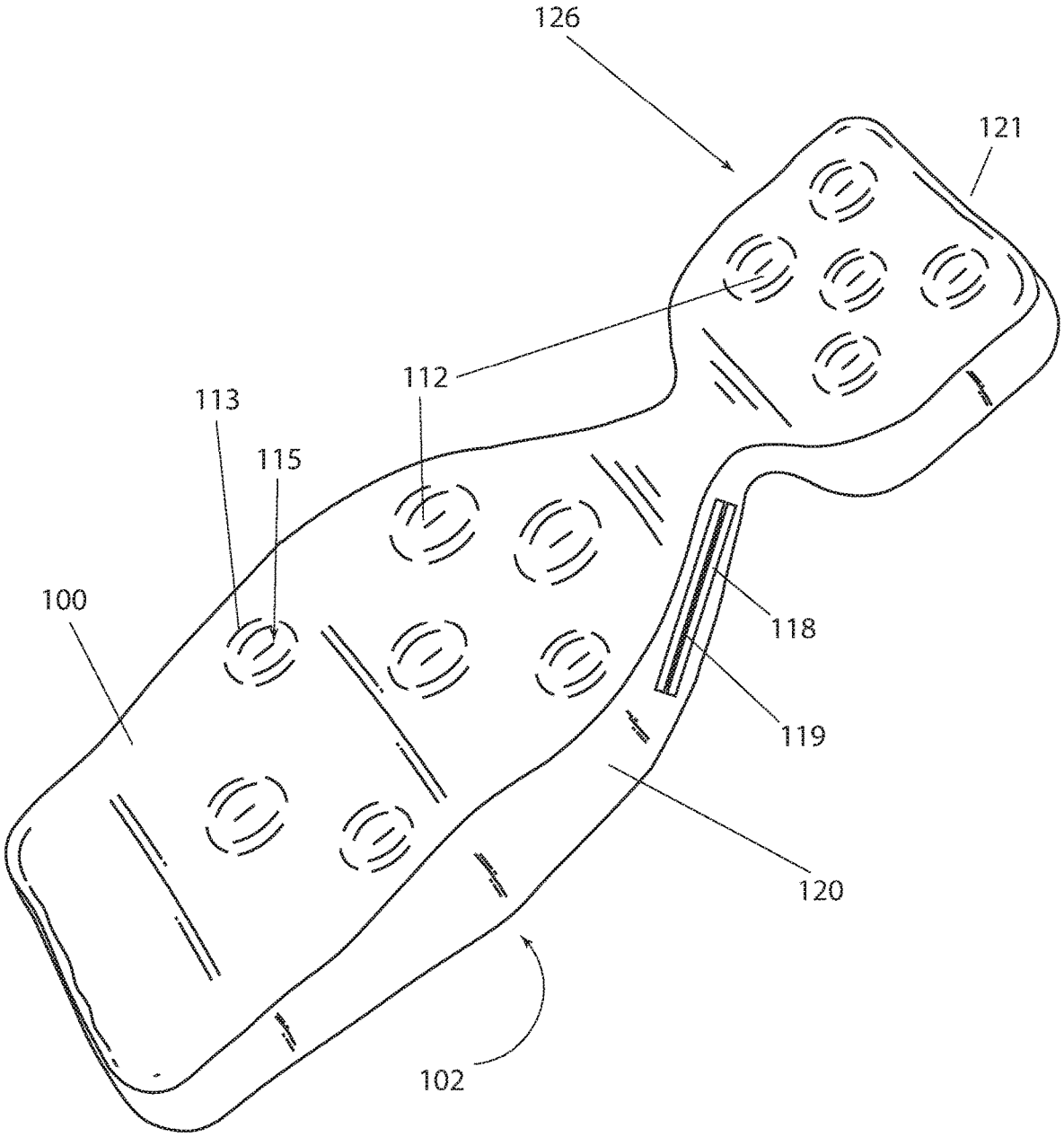
FIG. 6 is a perspective view of a completed pillow showing the various locations of the ribbon pairs (interconnected combinations) that are used to control the thickness of the pillow, which may vary from point to point across the pillow, and showing an example of a shape achievable in constructing the pillow in accordance with the methods and teaching of the disclosure.
Figure 7:
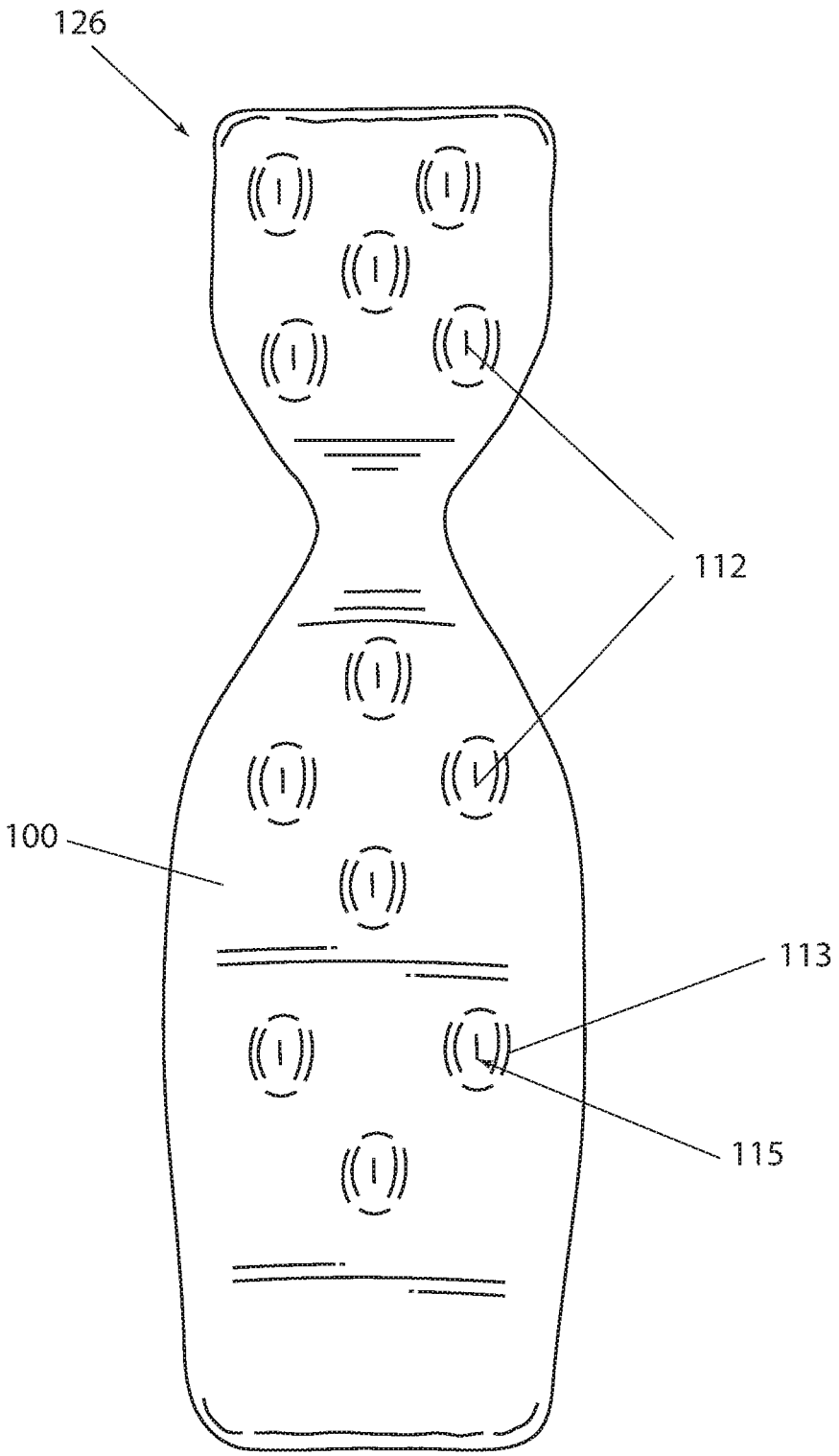
FIG. 7 is a top view of a completed body pillow, showing an example of a shape achievable in constructing the pillow in accordance with the methods and teaching of the disclosure.

Referring to FIGS. 6-7, a completed pillow 126 comprises a top pillow cover 100, an optional side panel 120, a closeable opening 118 and zipper 119, a bottom pillow cover 102, and one or more internal ribbon pairs 110 (not shown in FIGS. 6 and 7) that have been connected during a fill process. Thus, the ribbons 108 of the ribbon pairs 110 are internal to the pillow 126, they are attached to the top pillow cover 100 and the bottom pillow cover 102 at ribbon attachment zones 112, and the effects of that attachment may be visible through stitches 113 or a depression 115 in the pillow.

Referring to FIG. 8, in accordance with an embodiment, it is shown that the thickness of the pillow 126 may vary due to various length of the ribbon pairs 110 (shown in phantom) at various locations within the pillow. Further, it will be appreciated that the density of fill at one area of the pillow, say upper area 101, may be greater than the density of fill at another area of the pillow, say central area 103, whereas the density of another area of the pillow, say area 105, may be greater again than at other areas, say 103 and 107.

Referring thus specifically to FIGS. 8 and 9, it is shown that a pillow 126 may be adapted in shape and thickness to a human body, providing appropriate cushioning at various points of the body, with areas 101 (chest), 103 (thighs), 105 (knees), 107 (calves and ankles), and 111 (waist) each having differing thicknesses and densities, and therefore these provide a more comfortable experience for the user. Thus, it will be appreciated, for example, that area 101 may be more dense to accommodate a chest area of a user not collapsing down during sleep, the areas 103 and 107 may be less dense to accommodate inner thigh areas and calf areas of users, respectively, whereas the area 105 may be more dense to accommodate knee areas of the user. Furthermore, it will be appreciated that the various elements of the subject invention, such as interconnectible thickness controlling members 108, may be implemented as described to effectuate a change in taper at a location (for example at area 105 or 101 of the pillow 126) along the length, or width, of the pillow, or to maintain a certain level of thickness along a portion of the pillow, e.g., at 101). Further, accordingly, it will be appreciated that, for example, the contourse of a scooped-neck chiropractic pillow, may be created and maintained in a stuffed pillow 126 in accordance with the variable length interconnectible member combination as described.

While a preferred embodiment of the present disclosure has been shown and described, it will be apparent to those skilled in the art that many changes and modifications may be made without departing from the disclosure in its broader aspects. For example, it will be appreciated that one of ordinary skill in the art may mix and match the various components of the various embodiments of the disclosure without departing from the true spirit of the invention as claimed. The appended claims are therefore intended to cover all such changes and modifications as fall within the true spirit and scope of the invention.

We claim:

1. A pillow having varying levels of sustainable thickness or taper along at least one dimension of the pillow, comprising:

a top pillow cover comprising an inside surface, an outside surface, and a perimeter;

a bottom pillow cover comprising an inside surface, an outside surface, and a perimeter;

at least one elongated interconnecting member, said top pillow cover and said bottom pillow cover being interconnected with said at least one elongated interconnecting member;

a plurality of interconnectible thickness controlling members, at least one of said plurality of thickness controlling members comprising a first portion attached to the inside surface of the top pillow cover;

the at least one of said plurality of interconnectible thickness controlling members also comprising a second portion separate from but interconnectible with the first portion and attached to the inside surface of the bottom pillow cover;

a fill material retained within the pillow and held in place with said plurality of interconnectible thickness controlling members, said plurality of interconnectible thickness controlling members enabling varying levels of thickness or taper along at least one dimension of the pillow, wherein one portion of the pillow is filled to a given thickness or taper along a length or width of the pillow and another portion of the pillow is filled to another thickness or taper along another length or width of the pillow, the transition from the given thickness or taper to the another thickness or taper being controlled by an intermediate one of said plurality of interconnectible thickness controlling members, a closeable opening in the pillow having allowed access to the interior of the pillow, wherein the pillow is adapted for use as a body pillow, wherein each of said top pillow cover and said bottom pillow cover are of a length corresponding roughly to the length of a human body, and wherein said plurality of interconnectible thickness controlling members comprises a plurality of interconnectible ribbons, at least one of said plurality of interconnectible ribbons having a first portion and a second portion, each of said plurality of interconnectible ribbons being attached at a different location lengthwise and widthwise of the pillow, and the at least one of said plurality of interconnectible ribbons being of adjustable length adapted to maintain at least one of variable thickness and fill density of the pillow along a dimension of the pillow, the first and second portions of the at least one of said plurality of interconnectible ribbons being interconnected with each other, the pillow being adaptable to cushioning varying portions of the human body such as chest, abdomen, hips, knees, thighs, and ankles.

2. A pillow having varying levels of sustainable thickness or taper along at least one dimension of the pillow, comprising:

a top pillow cover comprising an inside surface, an outside surface, and a perimeter;

a bottom pillow cover comprising an inside surface, an outside surface, and a perimeter;

at least one elongated interconnecting member, said top pillow cover and said bottom pillow cover being interconnected with said at least one elongated interconnecting member;

a plurality of interconnectible thickness controlling members, at least one of said plurality of interconnectible thickness controlling members comprising a first portion, attached to the inside surface of the top pillow cover;

the at least one of said plurality of interconnectible thickness controlling members also comprising a second portion separate from but interconnectible with the first portion and attached to the inside surface of the bottom pillow cover;

a fill material retained within the pillow and held in place with said plurality of interconnectible thickness controlling members, said plurality of interconnectible thickness controlling members enabling varying levels of thickness or taper along at least one dimension of the pillow, wherein one portion of the pillow is filled to a given thickness or taper along a length or width of the pillow and another portion of the pillow is filled to another thickness or taper along another length or width of the pillow, the transition from the given thickness or taper to the another thickness or taper being controlled by an intermediate one of said, plurality of interconnectible thickness controlling members, a closeable opening in the pillow having allowed access to the interior of the pillow, wherein the first portion of the at least one of said plurality of interconnectible thickness controlling members has a hook sewn thereon, wherein the second portion of the at least one of said plurality of interconnectible thickness controlling members has a loop sewn therein, and wherein the hook and loop are interconnected within the pillow to enable variable thickness or variable taper areas along one or more dimensions of the pillow.

3. The pillow of claim 2, wherein the hook is a g-hook.

4. The pillow of claim 2 wherein each of said plurality of interconnectible thickness controlling members is comprised of a first somewhat flexible portion sewn to the inside surface of the top pillow cover and a corresponding second somewhat flexible portion sewn to the inside surface of the bottom pillow cover, each of the first somewhat flexible portion and the second somewhat flexible portion being comprised of one of a single hook and loop portions, snap and receptacle portions, hook and multiple loop portions, stick and loop portions, and g-hook and sewn-in loop portions, adapted for interconnecting with a corresponding portion of said plurality of interconnectible thickness controlling members.

5. The pillow of claim 1, wherein said top pillow cover and said bottom pillow cover are interconnected with said at least one elongated an interconnecting member with internal hidden seams.

6. The pillow of claim 2, wherein said top pillow cover and said bottom pillow cover are interconnected with said at least one elongated interconnecting member with internal hidden seams.

7. The pillow in accordance with claim 1, comprising:

a wide section of sufficient size and thickness controlled by a plurality of said plurality of interconnectible thickness controlling members to be comfortable when hugged to the chest of a person, supporting the elbows and arms in natural positions;

a narrow and thinner section for passing in front of the hips of the person where less cushioning is needed;

a wider and thicker section controlled by another plurality of said plurality of interconnectible thickness controlling members for passing between the thighs and knees of the person, providing substantial cushioning especially for the knees; and a thinner section controlled by yet another plurality of said plurality of interconnectible thickness controlling members for passing between the ankles of the person, allowing freedom of movement and a moderate amount of cushioning for the ankles.

* * * * *